United States Patent [19]

Doi et al.

[11] 4,201,592

[45] May 6, 1980

[54] PLATING-INHIBITOR FOR PARTIALLY PLATING STEEL PLATE WITH MOLTEN METAL

[75] Inventors: Koichi Doi, Toyonaka; Hisao Kato, Hirakata; Takeo Kurauchi, Neyagawa, all of Japan

[73] Assignees: Nisshin Steel Co., Ltd., Tokyo; Nippon Paint Co., Ltd., Osaka, both of Japan

[21] Appl. No.: 835,814

[22] Filed: Sep. 22, 1977

[30] Foreign Application Priority Data

Oct. 14, 1976 [JP] Japan ..... 51-122324

[51] Int. Cl.[2] ..... C23C 1/02

[52] U.S. Cl. ..... 106/2; 106/71; 106/14.12; 148/6.15 R; 148/22; 427/300

[58] Field of Search ..... 148/22, 6.15 R; 427/328, 300; 228/214; 106/2, 71, 14.12

[56] References Cited

U.S. PATENT DOCUMENTS

| | | | |
|---|---|---|---|
| 2,835,618 | 5/1958 | Keller et al. | 148/6.15 R |
| 3,104,993 | 9/1963 | Sievert et al. | 148/6.15 R |
| 3,181,963 | 5/1965 | Cook et al. | 427/300 |
| 3,207,636 | 9/1965 | Wada et al. | 148/22 |
| 3,213,302 | 10/1965 | Barney | 148/6.15 R |
| 3,398,010 | 8/1968 | Harvey et al. | 427/300 |
| 3,996,073 | 12/1976 | Evans | 148/6.15 R |
| 4,101,345 | 7/1978 | Hunter et al. | 427/300 |

OTHER PUBLICATIONS

Condensed Chemical Dictionary, Van Nostrand Reinhold Co., Eighth Ed., C 1971, p. 228.

*Primary Examiner*—John D. Smith

*Attorney, Agent, or Firm*—Wenderoth, Lind & Ponack

[57] ABSTRACT

This invention relates to a plating-inhibitor used in partially plating a steel plate with a molten metal, characterized by comprising (a) one or more water-soluble phosphate type bases selected from the group consisting of metal phosphates, metal condensed phosphates and their modified metal phosphates, a part of the water-soluble phosphate type bases being optionally replaced by one or more of the group of alkali metal silicates, quaternary ammonium silicate, silica sol and alumina sol; and (b) one or more inorganic inert powdery materials which are heat-resistant and substantially non-reactive with the molten metal.

18 Claims, No Drawings

PLATING-INHIBITOR FOR PARTIALLY PLATING STEEL PLATE WITH MOLTEN METAL

DETAILED EXPLANATION OF THE INVENTION

The present invention relates to a plating-inhibitor which is used in partially plating a steel plate and the like with a molten metal. The present invention also relates to a method for partially plating a steel plate and the like with a molten metal using said plating-inhibitor.

More particularly, this invention relates to a plating-inhibitor and a method for partially plating a steel plate and the like (hereinafter simply referred to as a "steel plate") which comprises coating the plating-inhibitor having the particular composition described hereinafter on the part of the steel plate where the plating is to be inhibited; drying the coated steel plate; introducing the dried steel plate into a molten metal bath where the desired part of the steel plate is plated; and removing the coating of plating-inhibitor.

Steel plate products plated with zinc, aluminum, lead, tin or alloys thereof are used in various fields because of their excellent anti-corrosion property.

Said steel plate products generally have plated layers on both sides of the plate. However, practically, it is a very rare case where a high anti-corrosion property is required on both sides of the plate. The plated layers on the contrary introduce adverse effects on the weldability and paintability of the steel plate in processing the steel plate product.

Under these circumstances, various methods for partially plating a steel plate with molten metal have been conceived. Examples of these conventional methods include a method for contacting only the desired part of the steel plate with molten metal and a method for treating the part of the steel plate where plating is not desired beforehand in such a manner as to inhibit plating.

The former method wherein only the desired part of the steel plate is contacted with the molten metal is carried out by dipping two overlapping steel plates in a molten metal bath or by controlling an apparatus in such a manner as to have only a part of a steel plate contact the molten metal. However, according to this method, it is very difficult to obtain a satisfactory steel plate since the molten metal often infiltrates through a gap, and temper color appears due to high temperature on the part of the steel plate where plating is not applied. It requires great labor to remove such temper color.

The following plating-inhibitors are known to be used in the latter method which comprises coating a plating-inhibitor on the part of the steel plate where plating is not desired, drying the coated plate and dipping the plate into a molten metal bath. For example, Japanese Patent Publication No. 7112/64 and Japanese Patent Laid Open No. 36054/73 disclose a method using a plating-inhibitor containing water glass as the main ingredient. Japanese Patent Publication No. 24966/67 discloses a method using a plating-inhibitor comprising phosphoric acid, a surface-active agent and the like. U.S. Pat. No. 3,104,993 discloses a method using a plating-inhibitor comprising phosphoric acid and silica sol. Japanese Patent Publication No. 40056/74, Japanese Patent Publication No. 8101/76 and Japanese Patent Laid Open No. 3836/74 disclose a method using a plating-inhibitor containing silicone resin as the main ingredient.

In the case of the above mentioned plating-inhibitor containing water glass alone, the coating operation can not be smoothly conducted, and it is therefore difficult to obtain a uniform coating. Temper color easily appears on parts where the coating is thin, and molten metal is liable to adhere to parts where the coating is thick. Moreover, since the coating thus formed is very hard, it is difficult to remove the coating after the plating process. In the case of a plating-inhibitor containing graphite, because of its lubricative property, it is also difficult to remove the plating-inhibitor after the plating process.

The phosphate type plating-inhibitor has disadvantages in that if the chemically formed film on the steel plate is thin, temper color appears on the steel plate, and that if the chemically formed film is thick, molten metal is liable to adhere thereto.

The plating-inhibitor comprising phosphoric acid and silica sol has the disadvantage that the coating operation can not be satisfactorily carried out and it is therefore difficult to obtain a uniform coating since the viscosity of the plating-inhibitor is too low. If the coating is thin, temper color appears, and if the coating is thick, a very hard film is formed, which can not be easily removed after the plating process.

In the case of the method using silicone resin as the plating-inhibitor, it is necessary to heat the silicone resin at a high temperature of 600°–700° C. for a long time in order to completely convert the silicone resin into $SiO_2$.

Under these circumstances, the development of an industrially practical method for partially plating a steel plate which does not have the above mentioned disadvantages is now demanded.

As a result of the study for an industrially practical method for partially plating a steel plate with molten metal, we have developed an industrially practical plating-inhibitor and a method for partially plating a steel plate with a molten metal using said plating-inhibitor which completely inhibits a selected part of a steel plate from being plated and which is easily removed after the plating process, thus satisfactorily plating only the desired part of a steel plate.

Thus, as a result of the study for a plating-inhibitor used in partially plating a steel plate with a molten metal such as zinc, aluminum, lead, tin or an alloy thereof, we have discovered that the above mentioned disadvantages can be removed by using a plating-inhibitor obtained by combining phosphate with an inorganic inert material in a specific ratio. According to the method using the plating-inhibitor of the present invention, the occurrence of temper color and the adherence of the molten metal to the plating-inhibitor layer are completely prevented, and the removal of the plating-inhibitor layer can be easily accomplished.

The plating-inhibitor of the present invention is characterized by containing one or more phosphates and one or more inorganic inert materials which are heat-resistant and do not react with molten metal.

The phosphate ingredient used in the plating-inhibitor of the present invention must have a film-formability and high heat-resistance as essential conditions. It is classified into the following three groups; the metal phosphate group; the metal condensed phosphate group; and their modified phosphate groups.

Typical examples of the metal phosphate group include water-soluble compounds having a metal oxide/- phosphoric acid, $xM_2O_x/P_2O_5$ (M=a metal atom having a valence of 1 to 4; x=the valence of the metal atom) mole ratio of 0.3–3.0, for example phosphates of sodium, potassium, zinc, aluminum, calcium, chromium, titanium, iron, copper, barium, magnesium, manganese or the like.

Typical examples of the metal condensed phosphate group include water-soluble pyrophosphate, acidic pyrophosphate, tripolyphosphate, tetrapolyphosphate, hexametaphosphate, metaphosphate or acidic metaphosphate of sodium, potassium, zinc, aluminum, calcium, chromium, titanium, iron, copper, barium, magnesium, manganese or the like.

Typical examples of the modified phosphate group include compounds obtained by adding at least one metal oxide, metal hydroxide, boric acid, metal borate, alkali metal silicate, alkali earth metal silicate or the like which reacts with orthophosphoric acid, to at least one of the phosphates of said metal phosphate group and said metal condensed phosphate group and stirring and dissolving the resultant mixture at room temperature or at high temperature to modify the phosphate; or compounds obtained by adding clay minerals or the like to at least one of the phosphates of said metal phosphate group and said metal condensed phosphate group and heating the resultant mixture at a temperature of 120°–280° C. to modify the phosphate. For example, at least one of the oxides or hydroxides of aluminum, magnesium, calcium, barium, chromium, zinc, iron, manganese and the like is added to at least one of the above mentioned phosphates containing metal having a valence of 2–4 in a metal oxide/phosphoric acid, $xM'_2O_x/P_2O_5$ (M'=a metal atom having a valence of 2 to 4; x=the valence of the metal atom) mole ratio of 0.7–1.3 to obtain a water-soluble modified phosphate; at least one of boric acid and the borates of magnesium, nickel, copper, cadmium, zinc and the like is added to at least one of the above mentioned phosphates in a $B_2O_3$ amount of 0.1–10% by weight and the resultant mixture is then stirred in the presence of heat to react and dissolve in order to prepare a water-soluble modified phosphate; at least one of the alkali metal silicates or alkali earth metal silicates which are only slightly soluble or insoluble in water is added to at least one of the above mentioned phosphates, and the resultant mixture is reacted with stirring at room temperature or in a hot bath to prepare a water-soluble modified phosphate; or at least one member selected from clay minerals containing silica and alumina, borax, fluorite, kaolinite and the like which is powdered is added to at least one of the above mentioned phosphates in an amount of 3–10% by weight, and the resultant mixture is heated in a reducing atmosphere at 120°–230° C. in the case of phosphate containing aluminum, magnesium or calcium, or at 120°–280° C. in the case of phosphate containing copper, zinc, iron or manganese to prepare a modified phosphate.

Among these phosphate type bases, phosphates having a relatively lower metal oxide/phosphoric acid mole ratio are hygroscopic, while those having a relatively higher mole ratio are not satisfactorily diluted in water. Alkali metal phosphates have good film-formability, but are somewhat hygroscopic. Among metal phosphates containing metal atoms having a valence of 2–4, phosphates of calcium, zinc or the like are less hygroscopic but have slightly poor adhesive properties; phosphates of aluminum, magnesium or the like are less hygroscopic and have somewhat improved adhesive properties and film-formability; and phosphates of iron, copper, manganese or the like are somewhat hygroscopic and have slightly poor adhesive properties.

With regard to the water-soluble modified phosphate obtained by adding at least one of the oxides or hydroxides of aluminum, magnesium, calcium, barium, chromium, zinc, iron, manganese and the like to at least one of the above mentioned phosphates containing metal having a valence of 2–4 in a metal oxide/phosphoric acid, $xM'_2O_x/P_2O_5$ (M'=a metal atom having a valence of 2 to 4; x=the valence of the metal atom) mole ratio of 0.7–1.3 and stirring at room temperature or in a hot bath to react and dissolve the ingredients, the hygroscopic property and film-formability can be controlled by the amount and the kind of metals used in the phosphate base and the added compounds although they are also variable depending on the state of the starting materials and the reaction temperature. In the case of water-soluble modified phosphate obtained by adding at least one of boric acid and the borates of magnesium, nickel, copper, cadmium, zinc and the like to at least one of the above mentioned metal phosphates containing metal having a valence of 2–4 or to the above mixture of at least one of the phosphates with at least one of the metal oxides or metal hydroxides in a $B_2O_3$ amount of 0.1–10% by weight and stirring in the presence of heat to react and dissolve, stability is more improved than in the case of a metal phosphate base alone.

In the case of water-soluble modified phosphate obtained by adding at least one alkali metal silicate or alkali earth metal silicate which is only slightly soluble or insoluble in water to at least one of the above mentioned metal phosphates containing metal having a valence of 2–4 and stirring the resultant mixture at room temperature or in a hot bath to react, its film-formability becomes somewhat poor but its crystallinty becomes good and its hygroscopic property becomes better (i.e. less hygroscopic) as compared with the case of metal phosphate base alone.

The modified phosphate obtained by adding at least one of powdery clay minerals containing silica and alumina, borax, fluorite, kaolinite and the like to at least one of the above mentioned metal phosphates containing metal having a valence of 2–4 in an amount of 3–10% by weight and heating the resultant mixture in a reducing atmosphere at 120°–280° C. is less hygroscopic than a metal phosphate base alone.

These phosphate type bases have film-formability and adhesive properties to a steel plate to some extent, and accordingly they are not separated from the steel plate when dipped into a molten metal bath. Moreover, the coating having a certain level of thickness prevents the appearance of temper color. However, as mentioned above, the use of phosphate type base alone as a plating-inhibitor causes temper color on a steel plate when it is coated as a thin film, and forms a very hard film difficulty removable when it is coated as a thick film. Thus, the use of phosphate type base alone is not effective in view of the problems of temper color, adherence of molten metal and the removal of the plating-inhibitor film layer.

The above problems can be solved by combining an inorganic inert material with a phosphate type base in accordance with the present invention, and the effect achieved by each phosphate type base is a little different depending on the objective. For example, a component having good film-formability provides a relatively good effect for the prevention of temper color, and a component having a low hygroscopic property and a little crystallinity provides relatively good effects for the prevention of the undesired adherence of molten metal and the removal of plating-inhibitor layer.

The coating film of the plating-inhibitor of the present invention mainly comprises amorphous material obtained by the condensation of a part of metal phosphate having a low mole ratio in the presence of heat, and is different from the ordinary coating film containing tertiary phosphate as the main component. Accordingly, as compared with ordinary coating film, the film of the plating-inhibitor of the present invention has a much lower porosity, and some of the phosphate type bases have active phosphate radicals partly remaining which provide excellent effects on the prevention of temper color. Thus, the phosphate type base can be used with only one component or it may be used with two or more components in consideration of adhesive property, film-formability, hygroscopic property, crystallinity, coating efficiency or stability.

According to the present invention, a part of the phosphate type base used may be optionally replaced in the following manner; that is, (a) The phosphate type base may be partly replaced by a water-soluble or water-dispersible alkali metal silicate or quaternary ammonium silicate in a non-volatile content amount of 30% or less by volume on the basis of the total volume amount of the phosphate type base and the alkali metal silicate or quaternary ammonium silicate;

(b) The phosphate type base may be partly replaced by silica sol and/or alumina sol in a non-volatile content amount of 80% or less by volume on the basis of the total volume amount of the phosphate type base and silica sol and/or alumina sol; and (c) The phosphate type base may be partly replaced by a water-soluble or water-dispersible alkali metal silicate or quaternary ammonium silicate as well as by silica sol and/or alumina sol, the non-volatile content amount of the alkali metal silicate or quaternary ammonium silicate being 30% or less by volume on the basis of the total volume amount of the phosphate type base and the alkali metal silicate or quaternary ammonium silicate, and the non-volatile content amount of the silica sol and/or alumina sol being 80% or less by volume on the basis of the total volume amount of the phosphate type base and the silica sol and/or alumina sol. More particularly, (1) The phosphate type base may be partly replaced by a water-soluble or water-dispersible alkali metal silicate in a non-volatile volume amount of 30% or less by volume on the basis of the total volume amount of the phosphate type base and the alkali metal silicate;

(2) The phosphate type base may be partly replaced be a water-soluble or water-dispersible quaternary ammonium silicate in a non-volatile volume amount of 30% or less by volume on the basis of the total volume amount of the phosphate type base and the quaternary ammonium silicate;

(3) The phosphate type base may be partly replaced by silica sol in a non-volatile volume amount of 80% or less by volume on the basis of the total volume amount of the phosphate type base and the silica sol;

(4) The phosphate type base may be partly replaced by alumina sol in a non-volatile volume amount of 80% or less by volume on the basis of the total volume amount of the phosphate type base and the alumina sol;

(5) The phosphate type base may be partly replaced by both silica sol and alumina sol, the total non-volatile content amount of silica sol and alumina sol being 80% or less by volume on the basis of the total volume amount of the phosphate type base, silica sol and alumina sol;

(6) The phosphate type base may be partly replaced by a water-soluble or water-dispersible alkali metal silicate and silica sol, the non-volatile content amount of the alkali metal silicate being 30% or less by volume on the basis of the total volume amount of the phosphate type base and the alkali metal silicate, and the non-volatile content amount of the silica sol being 80% or less by volume on the basis of the total volume amount of the phosphate type base and the silica sol;

(7) The phosphate type base may be partly replaced by a water-soluble or water-dispersible alkali metal silicate and alumina sol, the non-volatile content amount of the alkali metal silicate being 30% or less by volume on the basis of the total volume amount of the phosphate type base and the alkali metal silicate, and the non-volatile content amount of the alumina sol being 80% or less by volume on the basis of the total volume amount of the phosphate type base and the alumina sol;

(8) The phosphate type base may be partly replaced by a water-soluble or water-dispersible quaternary ammonium silicate and silica sol, the non-volatile content amount of the quaternary ammonium silicate being 30% or less by volume on the basis of the total volume amount of the phosphate type base and the quaternary ammonium silicate, and the non-volatile content amount of the silica sol being 80% or less by volume on the basis of the total volume amount of the phosphate type base and the silica sol;

(9) The phosphate type base may be partly replaced by a water-soluble or water-dispersible quaternary ammonium silicate and alumina sol, the non-volatile content amount of the quaternary ammonium silicate being 30% or less by volume on the basis of the total volume amount of the phosphate type base and the quaternary ammonium silicate, and the non-volatile content amount of the alumina sol being 80% or less by volume on the basis of the total volume amount of the phosphate type base and the alumina sol;

(10) The phosphate type base may be partly replaced by a water-soluble or water-dispersible alkali metal silicate, silica sol and alumina sol, the non-volatile content amount of the alkali metal silicate being 30% or less by volume on the basis of the total volume amount of the phosphate type base and the alkali metal silicate, and the total non-volatile content amount of silica sol and alumina sol being 80% or less by volume on the basis of the total volume amount of the phosphate type base, silica sol and alumina sol; and

(11) The phosphate type base may be partly replaced by water-soluble or water-dispersible quaternary ammonium silicate, silica sol and alumina sol, the non-volatile content amount of the quaternary ammonium silicate being 30% or less by volume on the basis of the total volume amount of the phosphate type base and the quaternary ammonium silicate, and the total non-volatile content amount of silica sol and alumina sol being 80% or less by volume on the basis of the total volume amount of the phosphate type base, silica sol and alumina sol.

The alkali metal silicate used in the present invention is water-soluble or water-dispersible, and expressed by the general formula, has a $SiO_2/M''_2O$ (M''=alkali metal) mole ratio of 1.0–20. Examples of the alkali metal silicate include lithium silicate having an $SiO_2/Li_2O$ mole ratio of 1.0–20, sodium silicate having an $SiO_2/Na_2O$ mole ratio of 1.0–20, and potassium silicate having an $SiO_2/K_2O$ mole ratio of 1.0–20.

The quaternary ammonium silicate used in the present invention is prepared by passing an aqueous solution of a mixture of the above alkali metal silicates with water-soluble amines through an ion-exchange resin or by dissolving silica gel in a hydroxide solution of quaternary ammonium. Examples of the quarternary ammonium silicate include silicates having, as a quaternary ammonium radical, tetraethanol ammonium, methyl triethanol ammonium, dimethyl diethanol ammonium, trimethyl ethanol ammonium, tetramethanol ammonium or phenyl trimethyl ammonium. These compounds are expressed by an $SiO_2/R_2O$ mole ratio where R represents a quaternary ammonium radical.

The silica sol and alumina sol used in the present invention are colloids of silica or alumina stabilized with acid or alkali.

More particularly, the silica sol is a colloidal solution of ultra-fine silicic anhydride ($SiO_2$) particles having a particle size of 1–100 mμ, preferably 10–20 mμ in a dispersion medium such as water or organic solvent. Typical examples include an alkali-stabilized colloid having a pH of 8.0–10.0, a silica content of 20–40% by weight and an $Na_2O$ content of 0.6% or less by weight and an acid-stabilized colloid having a pH of 3.0–4.0, a silica content of 20–21% by weight and an $Na_2O$ content of 0.02% or less by weight.

The alumina sol is a colloidal solution of alumina having a particle size of 1–250 mμ in water as a dispersion medium, typically an acid-stabilized alumina sol having a pH of 2.5–6.0, an alumina ($Al_2O_3$) content of 10% or more by weight and an average particle size of 50–100 mμ×10 mμ.

A mixture of silica sol and alumina sol interacts and provides an excellent heat-resistant film. These water-soluble or water-dispersible alkali metal silicate or quaternary ammonium silicate and/or silica sol and/or alumina sol can be mixed with a phosphate type base in an arbitrary ratio if the non-volatile material content of the plating-inhibitor is sufficiently low. However, taking coating efficiency, storage stability and the like of the plating-inhibitor into consideration, these components should be mixed with the phosphate type base in the above mentioned ratio.

When a water-soluble or water-dispersible alkali metal silicate or quaternary ammonium silicate is added to a phosphate type base, if the phosphate type base is an alkali metal phosphate, the film formability of the base is improved thereby achieving a desirable effect on the prevention of temper color, and if the phosphate type base is a metal phosphate having a metal atom valence of 2–4 or is its modified phosphate, the crystallinity of the film of the plating-inhibitor is increased thereby achieving desirable effects on the prevention of adherence of molten metal to the film of the plating-inhibitor and ease of the removal of the plating-inhibitor layer. When silica sol and/or alumina sol are added to a phosphate type base, if the amount added is small, a dense film is formed thereby preventing temper color, and if the amount added is large, the hygroscopic property of the film is lowered thereby achieving desirable effects on the prevention of adherence of molten metal to the plating-inhibitor film and ease of removal of the plating-inhibitor layer.

When a water-soluble or water-dispersible alkali metal silicate or quaternary ammonium silicate and silica sol and/or alumina sol are added in combination, their desirable effects appear synergistically. Thus, a mixture of a water-soluble or water-dispersible alkali metal silicate or quaternary ammonium silicate and/or silica sol and/or alumina sol with a phosphate type base can be used in the same manner as a phosphate type base alone.

The other essential ingredient of the plating-inhibitor of the present invention is an inert inorganic material which is water-insoluble or only slightly soluble in water, and which is highly heat-resistant. This material does not substantially react with molten metal and does not substantially interact with the phosphate type base at low temperature in a short time. However, this material may interact with the phosphate type base with the action of the heat of drying before plating or of the heat of dipping in the molten metal bath to such an extent that an effect for the prevention of adherence of the molten metal is achieved or that an easily removable plating-inhibitor film is formed. Generally, plating with molten metal is carried out at a temperature of 300°–950° C., and accordingly it is an essential condition that the inert inorganic material should not be subjected to melting, evaporation, oxidation, reduction, decomposition or the like at this temperature.

Examples of inert inorganic materials which satisfy the above mentioned conditions include titanium oxide, zinc white, chromium oxide, cobalt oxide, barium sulfate, talc, clay, mica, kaolin clay, asbestine, asbestos, calcium carbonate, alumina, siliceous sand, magnesium carbonate; and natural minerals such as feldspar, garnet, gypsum, quartz, olivine, chlorite, serpentine, lithium spodumene, alum, melilite, benitoite, wollastonite, analcite and the like; and synthetic mineral powders such as synthetic mica and the like.

The above mentioned inorganic inert materials are effective in preventing molten metal from adhering to the plating-inhibitor layer and also in preventing molten metal from contacting the steel plate where the plating-inhibitor is coated. However, since these inorganic inert materials alone can not adhere to a steel plate and can not form a continuous film, it is impossible to prevent the occurrence of temper color and the separation of the coated film if they are used alone. Thus, the use of the inert inorganic material alone does not achieve the desired object.

The object of the present invention is achieved by combining the inert inorganic materials with the above mentioned phosphate type bases or a phosphate type base, a part of which is replaced by one or more of alkali metal silicate, quaternary ammonium silicate, silica sol and alumina sol, thereby acquiring film-formability and heat-resistance. However, the effect achieved varies a little depending on the interaction of the two ingredients.

The interaction between the phosphate type base and the inert inorganic material varies depending on the ratio of the two. If the interaction is great, the effects appear in the prevention of adherence of molten metal and the removal of the plating-inhibitor, and if the interaction is little or non-existent, the effect appears in the prevention of temper color. Among the above mentioned inert inorganic materials, examples which greatly interact with the phosphate type bases include zinc white, chromium oxide, cobalt oxide, talc, mica, asbestine, asbestos, calcium carbonate, magnesium carbonate and the previously mentioned natural minerals.

Only one kind of inert inorganic material may be used or two or more kinds of inert inorganic materials may be used in order to obtain a balance in the interaction depending on the desired object.

According to the present invention, inert inorganic materials having a particle size of at least 0.1μ, preferably more than 1μ are mixed and dispersed. If the particle size of the inert inorganic material is less than 0.1μ, the coated film obtained therefrom becomes too strong, thereby making the removal of the plating-inhibitor layer difficult. The upper limit of the particle size varies depending on the coating method. For example, in the case of using a flow coater, the suitable particle size is 1-100μ.

In order to fully achieve the effect of the present invention, the mixing ratio of phosphate type base: inorganic inert material in the plating-inhibitor must be 5-70:95-30 on the basis of the non-volatile content volume ratio. If the non-volatile content volume amount of the inorganic inert material exceeds 95% by volume, it becomes difficult to obtain a continuous film and therefore temper color appears during plating. On the other hand, if the non-volatile content volume amount of the inert inorganic material is less than 30% by volume, the film obtained becomes too strong, thereby making the removal of the plating-inhibitor layer difficult.

If desired, in addition to the above main ingredients, organic or inorganic thickeners, surface active agents, water-soluble resins or emulsions may be added in order to control viscosity or to improve wetting property on a steel plate, dispersibility, storage stability, coating efficiency, film-formability or the like.

Typical examples of organic thickeners and surface active agents include polyvinyl alcohol, hydroxyethyl cellulose, carboxymethyl cellulose, alkyl benzene sulfonate, polyoxyethylene alkyl ether and the like. Typical examples of inorganic thickeners include "Osmos N" containing montmorillonite as the main ingredient (trade name, manufactured by Shiraishi Kogyo Co.), "Thickener" (trade name, manufactured by GAF Co.), "Bentone" and Beegum" (trade names, manufactured by National Lead Co.). Typical examples of water-soluble resins include polyvinyl alcohol, polyvinyl pyrrolidone, polyacrylic acid, polyvinyl methyl ether, copolymer of polyvinyl methyl ether/maleic anhydride, water-soluble melamine resin, and the like. Typical examples of the emulsion include copolymer of ethylene/vinyl acetate, copolymer of acrylic acid/vinyl versatic acetate, vinyl acetate polymer, copolymer of styrene/butadiene, copolymer of butadiene/acrylonitrile, urethane resin, silicone resin and the like.

The plating-inhibitor is prepared by fully mixing these ingredients for an appropriate time by means of a usual mixing machine for paint such as a ball mill, SG mill, colloid mill, roll mill, mixer or the like. The plating-inhibitor thus prepared is coated on a steel plate and the coating is dried. The coating is carried out by means of a usual coating machine such as an air sprayer, airless sprayer, roll coater, flow coater or the like. The coating should be uniform, and usually has a thickness of 3μ or more. The coating is then dried in an atmosphere of generally 100° C. or higher. If the thickness of the coated film is less than 3μ, the surface of the steel plate is not completely covered and therefore the occurrence of temper color and the undesired adherence of molten plate are caused. The upper limit of the thickness of the coated film varies depending on a method of removing the film later. For example, in the case of removing the film by brushing, the thickness of the film should be 3-100μ.

After drying, if the surface of the plating-inhibitor has defects such as flow, crack, cissing, foaming, uneven thickness and the like, problems occur such as the adherence of molten metal to undesired parts, the occurrence of temper color, difficulty in the removal of the plating-inhibitor layer and the like.

If the pretreatment such as flux coating for hot-dip galvanizing is carried out with the part of the steel plate where plating is to be applied, it can be carried out at the same time as the coating process for the plating-inhibitor or it may be conducted before or after the coating process for the plating-inhibitor, provided that it does not disturb the whole process.

The steel plate coated with the plating-inhibitor is then dipped into a molten metal bath usually for 2-20 seconds. The steel plate is then taken out of the bath and allowed to cool or subjected to rapid cooling. The plating-inhibitor layer is then removed by a physical or chemical method such as a method using a leveller; an abrasion method using Scotch Bright (abrasive), brush, sand paper or the like; a method using ultra-high pressure water; a method using an acid or alkali solution to dissolve the plating-inhibitor; and the like.

As mentioned above, according to the present invention, only the desired part of the steel plate is uniformly plated with molten metal, and the molten metal does not adhere to the part where the plating-inhibitor is applied. During the process of the present invention, temper color does not appear and the plating-inhibitor layer is easily and completely removed, thus accomplishing the desired object. When an ordinary phosphate film was applied to the unplated part thus obtained, there was no abnormal phenomenon.

Due to the development of the plating-inhibitor of the present invention, steel plates partly plated with molten metal can be easily produced on a large scale and the amount of molten metal consumed has become smaller.

The present invention is more concretely illustrated by the following Examples.

EXAMPLE 1

Plating-inhibitor (1) (non-volatile content=8.7% by volume) was prepared by mixing 11.8 parts by volume of primary aluminum phosphate aqueous solution (3 $Al_2O_3/P_2O_5$ mole ratio=1.0, non-volatile content=28.6% by volume) and 4.3 parts by volume of titanium oxide in a mixer and then adding 70 parts by volume of water to the resultant dispersion. The plating-inhibitor (1) thus prepared was coated by an air sprayer on one side of a clean steel plate, which had been previously degreased, water-washed and dried, in such a manner as to obtain a dry film thickness of 10μ, at a rate of 115 cc/m$^2$. The coated steel plate was then fully dried in a drying furnace at 400° C. to remove free moisture, and the surface of the dried film was checked. The steel plate with the film was then passed through a preheated furnace (a slight oxidative or nonoxidative atmosphere of 700°-880° C.) and a reductive furnace (an atmosphere containing hydrogen gas at 840° C.) for about two minutes. The steel plate was then dipped in a molten zinc bath at 460° C. for 5 seconds. The steel plate was then subjected to rapid cooling, and was checked with regard to the adherence of zinc to the surface of the plating-inhibitor, the occurrence of temper color and the removability of the plating-inhibitor layer. The adherence of zinc to the surface of the plating-inhibitor layer was checked with the naked eye. The occurrence of temper color was checked by bending the steel plate around a mandrel of a bending tester having a diameter of 10 mm, stripping the plating-inhibitor layer off with cellophane tape and observing the surface of the steel plate. The removability of the plating-inhibitor layer was checked by measuring reciprocation times of a brass wire brush of a Gardner washability tester loaded with 500 g until the naked surface of the steel plate was revealed. The surface of the coated steel plate was checked with the naked eye with regard to flowing, cracking, cissing, foaming, uniformity of film thickness and the like. The storage stability of the plating-inhibitor (1) was checked by putting a sample of the plating-inhibitor (1) in a sealed glass bottle, placing the bottle at room temperature and measuring the degree of settling and redispersibility of the sample after one week.

EXAMPLE 2

20 parts by weight of aluminum hydroxide (chemically pure reagent) was added to 100 parts by weight of orthophosphoric acid (chemicaly pure reagent) and was heat-dissolved at 80° C. 18 parts by weight of magnesium oxide (chemically pure reagent) was reated with the resultant solution while mixing, and 50 parts by weight of water was added to the resultant mixture to obtain a modified aluminum phosphate aqueous solution having a nonvolatile content of 33% by volume. 9.5 parts by volume of the modified aluminum phosphate aqueous solution thus prepared was mixed with 17.2 parts by volume of siliceous sand powder and 40 parts by volume of water, and the resultant mixture was fully mixed in a pot mill for 16 hours to prepare plating-inhibitor (2). One side of a steel plate which had previously been degreased, water-washed, acid-washed, and water-washed again, was coated with a flux solution (3 $ZnCl_2$—$NH_4Cl$ 20% aqueous solution), and the other side of the steel plate was coated with the plating-inhibitor (2) diluted with water in such a manner as to have a nonvolatile content of 28.5% by volume. The coating of the plating-inhibitor was conducted by a roll coater at a rate of 140 cc/m$^2$ in such a manner as to obtain a dry film thickness of 40$\mu$. The coated steel plate was then dried at 300° C. for one minute, and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (2) was also checked.

EXAMPLE 3

Plating-inhibitor (3) (non-volatile content=25% by volume) was prepared by mixing 32.7 parts by volume of primary magnesium phosphate aqueous solution (2 $MgO/P_2O_5$ mole ratio=1.0, non-volatile content=28.6% by volume) with 10 parts by volume of clay in a colloid mill, adding 25.7 parts by volume of water to the resultant mixed dispersion with stirring and then adding 15.6 parts by volume of alumina sol (non-volatile content=3.2% by volume, pH=4) to the resultant mixture.

The plating-inhibitor thus prepared was coated by an airless sprayer on a steel plate in such a manner as to obtain a dry film thickness of 5$\mu$ at a rate of 20 cc/m$^2$ according to the same procedure as in Example 2. The coated steel plate was then dried at 280° C. for one minute, and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (3) was also checked.

EXAMPLE 4

30 parts by weight of magnesium hydroxide (chemically pure reagent) was added to 100 parts by weight of orthphosphoric acid (chemically pure reagent), and was heat-dissolved at 100° C. 3 parts by weight of zinc white was mixed and reacted with the resultant solution and 100 parts by weight of water was added to the resultant mixture to prepare a modified magnesium phosphate aqueous solution having a non-volatile content of 24% by volume. 18.9 parts by volume of the modified magnesium phosphate thus prepared, 15.9 parts by volume of siliceous sand powder and 37 parts by volume of water were intimately mixed in a pot mill for 8 hours to prepare plating-inhibitor (4) (non-volatile content=28% by volume). The plating-inhibitor (4) thus prepared was coated by an air sprayer on a clean steel plate which had previously been degreased, water-washed, acid-washed and water-washed in such a manner as to obtain a dry film thickness of 20$\mu$, at a rate of 71 cc/m$^2$. The coated steel plate was then dried and the surface of the coating film was checked. After plating and cooling the steel plate, it was tested in the same manner as in Example 1. The storage stability of the plating-inhibitor (4) was also checked.

EXAMPLE 5

13.5 parts by weight of orthophosphoric acid (chemically pure reagent), 3 parts by weight of aluminum hydroxide (chemically pure reagent), 1 part by weight of boric acid (chemically pure reagent) and 60 parts by weight of water were mixed and reacted at 60° C. to prepare a modified aluminum phosphate aqueous solution having a non-volatile content of 9% by volume. 30.8 parts by volume of the modified aluminum phosphate aqueous solution thus prepared was mixed with 8.8 parts by weight of clay in an SG mill to prepare plating-inhibitor (5). As in Example 2, the plating-inhibitor (5) was diluted with 12 parts by volume of water in such a manner as to have a non-volatile content of 22% by volume of the diluted plating-inhibitor was coated on a steel plate by an air sprayer in such a manner as to obtain a dry film thickness of 15$\mu$ at a rate of 68 cc/m$^2$. The coated steel plate was then dried at 200° C. for 2 minutes and the surface of the coating film was checked. The steel plate was then dipped in a molten zinc bath at 460° C. for 4 seconds. The steel plate was then subjected to rapid cooling. A part of the steel plate was tested in the same manner as in Example 1, and the remaining part of the steel plate was tested with regard to the removability of the plating-inhibitor with Scotch Bright (abrasive). The storage stability of the plating-inhibitor (5) was also checked.

EXAMPLE 6

30 parts by weight of primary magnesium phosphate aqueous solution (2 $MgO/P_2O_5$ mole ratio=1.0, non-volatile content=50% by weight), 0.6 part by weight of boric acid (chemically pure reagent), 0.5 part by weight of active aluminum hydroxide ($Al_2O_3$=49.8%) and 0.3 part by weight of heavy magnesium oxide were mixed and dissolved in a hot water bath to prepare a modified magnesium phosphate having a non-volatile content of 30.4% by volume. 6.2 parts by volume of the modified magnesium phosphate thus prepared, 8.1 parts by volume of titanium oxide, 0.7 part by volume of mica, 2 parts by volume of 10% aqueous solution of methyl vinyl ether/maleic anhydride copolymer resin GANTREZ AN-119 (trade name, manufactured by GAF Co.) and 27.6 parts by volume of water were mixed in an SG mill. 12.0 parts by volume of acid-stabilized colloidal silica (non-volatile content=10% by volume, pH=3.5) was then added to the resultant dispersion to prepare plating-inhibitor (6) having a non-volatile content of 21% by volume. According to the same procedure as in Example 2, the plating-inhibitor (6) thus prepared was coated by an air sprayer on a steel plate in such a manner as to obtain a dry film thickness of 35μ at a rate of 167 cc/m$^2$. The coated steel plate was then dried at 180° C. for one minute, and the surface of the coating film was checked. The steel plate was then dipped in a molten zinc bath at 460° C. for 5 seconds. After subjecting the steel plate to rapid cooling, a part of the steel plate was tested in the same manner as in Example 1, and the remaining part was checked by a leveller with regard to the removability of the plating-inhibitor. The storage stability of the plating-inhibitor (6) was also checked.

EXAMPLE 7

5.6 parts by volume of primary magnesium phosphate aqueous solution (2 $MgO/P_2O_5$ mole ratio=1.0, non-volatile content=28.6% by volume), 3.4 parts by volume of siliceous sand powder and 3.1 parts by volume of clay were intimately mixed in a roll mill, and 76 parts by volume of water was added to the resultant dispersion to prepare plating-inhibitor (7) having a non-volatile content of 9% by volume. According to the same procedure as in Example 2, the plating-inhibitor (7) thus prepared was coated by an air sprayer on a steel plate in such a manner as to obtain a dry film thickness of 12μ at a rate of 133 cc/m$^2$. The coated steel plate was then dried at 230° C. for one minute, and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (7) was also checked.

EXAMPLE 8

Plating-inhibitor (8) having a non-volatile content of 18.8% by volume was prepared by fully mixing 23.1 parts by volume of primary aluminum phosphate aqueous solution (3 $Al_2O_3/P_2O_5$ mole ratio=1.0, non-volatile content=28.6% by volume), 14.8 parts by volume of titanium oxide, 1 part by volume of "Demol-N" 40% aqueous solution (trade name, manufactured by Kao Atlas Co.) and 61 parts by volume of acid-stabilized water in a pot mill for 10 hours and then adding 30.1 parts by volume of colloidal silica (non-volatile content=10% by volume, pH=3.5) to the resultant mixture dispersion.

According to the same procedure as in Example 2, the plating-inhibitor (8) thus prepared was coated by an air sprayer on a steel plate in such a manner as to obtain a dry film thickness of 10μ at a rate of 53 cc/m$^2$. The coated steel plate was then dried at 330° C. for 1.5 minutes, and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (8) was also checked.

EXAMPLE 9

Plating-inhibitor (9) having a non-volatile content of 19% by volume was prepared by mixing 28 parts by volume of primary magnesium phosphate aqueous solution (2 $MgO/P_2O_5$ mole ratio=1.0, non-volatile content=28.6% by volume), 0.8 part by volume of primary calcium phosphate aqueous solution (2 $CaO/P_2O_5$ mole ratio=0.4, non-volatile content=25% by volume), 2.4 parts by volume of titanium oxide, 2.2 parts by volume of mica, 5 parts by volume of "Osmos N" 5% aqueous solution and 78 parts by volume of water in a mixer.

The plating-inhibitor (9) thus prepared was coated by an air sprayer on a steel plate in such a manner as to obtain a dry film thickness of 5μ at a rate of 26 cc/m$^2$. The coated steel plate was then dried at 180° C. for one minute and the surface of the coating film was checked. According to the same procedure as in Example 1, the steel plate was plated and cooled and was then tested. The storage stability of the plating-inhibitor (9) was also checked.

EXAMPLE 10

Plating-inhibitor (10) was prepared by fully mixing 8.4 parts by volume of primary aluminum phosphate (3 $Al_2O_3/P_2O_5$ mole ratio=1.0, non-volatile content=28.6% by volume), 0.2 part by volume of sodium tripolyphosphate aqueous solution (non-volatile content=4% by voluem), 1 part by volume of "Pelex-NB" 10% aqueous solution (trade name, manufactured by Kao Atlas Co.), 17 parts by volume of talc, and 43 parts by volume of water in a pot mill for 8 hours. This plating-inhibitor was diluted with 20 parts by volume of water to make a non-volatile content of 24% by volume. The plating-inhibitor was then coated by an air sprayer on a steel plate at a rate of 83 cc/m$^2$ in such a manner as to obtain a dry film thickness of 20μ. After drying, the surface of the coating film was checked, and after plating and cooling the steel plate, it was tested in the same manner as Example 1. The storage stability of the plating-inhibitor (10) was also checked.

EXAMPLE 11

Plating-inhibitor (11) having a non-volatile content of 14% by volume was prepared by mixing 94 parts by volume of sodium tripolyphosphate aqueous solution (non-volatile content=4.3% by volume), 5.4 parts by volume of clay and 5.2 parts by volume of olivine powder in an SG mill. According to the same manner as in Example 2, the plating-inhibitor (11) was coated on a steel plate by an air sprayer at a rate of 86 cc/m$^2$ in such a manner as to obtain a dry film thickness of 12μ. The coated steel plate was then dried at 280° C. for one minute and the surface of the coating film was checked. The steel plate was then dipped in a molten zinc bath at 460° C. for 3 seconds, and after subjecting it to rapid cooling, it was tested in the same manner as in Example 1. The storage stability of the plating-inhibitor (11) was also checked.

EXAMPLE 12

Plating-inhibitor (12) having a non-volatile content of 7% by volume was prepared by mixing 17.5 parts by volume of aluminum phosphate aqueous solution (3

$Al_2O_3/P_2O_5$ mole ratio=0.5, non-volatile content=28.6% by volume), 0.8 part by volume of alumina, 1.2 parts by volume of barium sulfate, 2.9 parts by volume of titanium oxide and 117 parts by volume of water in a colloid mill and further adding 12.9 parts by volume of lithium silicate aqueous solution ($SiO_2/Li_2O$ mole ratio=4.5, non-volatile content=7% by volume).

According to the same procedure as in Example 2, the plating-inhibitor (12) thus prepared was coated on a steel plate by an air sprayer at a rate of 89 cc/m$^2$ in such a manner as to obtain a dry film thickness of 10$\mu$. The coated steel plate was then dried at 250° C. for one minute and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (12) was also checked.

EXAMPLE 13

A modified phosphate solution having a non-volatile content of 9% by volume was prepared by mixing 13.5 parts by weight of orthophosphoric acid (chemically pure reagent) with 2.5 parts by weight of aluminum hydroxide, 0.5 part by weight of zinc hydroxide, 0.5 part by weight of magnesium borate and 60.5 parts by weight of water and reacting the resultant mixture at 60° C. for 8 hours. Plating-inhibitor (13) having a non-volatile content of 19% by volume was prepared by mixing 44 parts by volume of the modified phosphate solution thus prepared, 12. parts by volume of titanium oxide, 2.3 parts by volume of clay and 2.6 parts by volume of quartz powder in a pot mill for 5 hours and then adding 4.3 parts by volume of tetraethanol ammonium silicate ($SiO_2/(N(C_2H_4OH)_4)_2O$ mole ratio−4.5, non-volatile content=7% by volume) to the resultant mixture dispersion.

According to the same procedure as in Example 2, the plating-inhibitor (13) thus prepared was coated on a steel plate by a roll coater at a rate of 89 cc/m$^2$ in such a manner as to obtain a dry film thickness of 17$\mu$. The coated steel plate was then dried at 300° C. for 2 minutes, and the surface of the coating film was checked. The steel plate was then dipped in a molten zinc bath at 460° C. for 5 seconds. After subjecting the steel plate to rapid cooling, it was tested in the same manner as in Example 1. The storage stability of the plating-inhibitor (13) was checked.

EXAMPLE 14

Plating-inhibitor (14) having a non-volatile content of 18.5% by volume was prepared by mixing 14 parts by volume of magnesium phosphate aqueous solution (2 $MgO/P_2O_5$ mole ratio=0.8, non-volatile content=28.6% by volume), 2.2 parts by volume of titanium oxide, 8.5 parts by volume of kaolin clay and 15 parts by volume of water in an SG mill, diluting the resultant mixture with water so as to have a non-volatile content of 25% by volume and then adding 0.9 part by volume of sodium silicate aqueous solution ($SiO_2/Na_2O$ mole ratio=3.2, non-volatile content=3.2% by volume) and 6.0 parts by volume of alkali-stabilized colloidal silica (non-volatile content=10% by volume, pH=10) to 10 parts by volume of the above diluted mixture.

The plating-inhibitor (14) thus prepared was coated by an air sprayer at a rate of 54 cc/m$^2$ on one side of a clean steel plate, which had been previously degreased, water-washed and dried, in such a manner as to obtain a dry film thickness of 10$\mu$. The coated steel plate was then fully dried in a drying furnace at 400° C. to remove free moisture, and the surface of the coating film was checked. The steel plate was then passed through a preheated furnace (a slight oxidative or non-oxidative atmosphere of 700°-880° C.) and a reductive furnace (an atmosphere containing hydrogen gas at 800° C.) for about two minutes. The steel plate was then dipped in a molten aluminum bath at 700° C. for 5 seconds. After subjecting the steel plate to rapid cooling, it was tested in the same manner as in Example 1. The storage stability of the plating-inhibitor (14) was also checked.

COMPARATIVE EXAMPLE 1

Comparative treating agent (I) having a non-volatile content of 24% by volume was prepared by mixing 23.7 parts by volume of orthophosphoric acid (85% reagent), 1.4 parts by volume of zinc white, 3.5 parts by volume of nickel nitrate hexahydrate (chemically pure reagent), 2.5 parts by volume of nitric acid (chemically pure reagent) and 43 parts by volume of water. According to the same procedure as in Example 2, the comparative treating agent (I) thus prepared was coated by an air sprayer on a steel plate at a rate of 20 cc/m$^2$ in such a manner as to obtain a dry film thickness of 5$\mu$. The coated steel plate was then dried at 350° C. for two minutes, and the surface of the coating film was checked. The steel plate was then dipped in a molten zinc bath at 460° C. for 5 seconds. After subjecting the steel plate to rapid cooling, it was tested in the same manner as in Example 1. The storage stability of the comparative treating agent (I) was also checked.

COMPARATIVE EXAMPLE 2

Comparative treating agent (II) having a non-volatile content of 18% by volume was prepared by mixing 9.2 parts by volume of orthophosphoric acid (85% by weight reagent), 10 parts by volume of sodium nitrate (chemically pure reagent), 0.4 part by volume of primary iron phosphate (chemically pure reagent) and 63 parts by volume of water. According to the same procedure as in Example 2, the comparative treating agent (II) thus prepared was coated by an air sprayer on a steel plate at a rate of 30 cc/m$^2$ in such a manner as to obtain a dry film thickness of 5$\mu$. The coated steel plate was then dried at 350° C. for two minutes, and the surface of the coating film was checked. The steel plate was then dipped in a molten zinc bath at 460° C. for 5 seconds. After subjecting the steel plate to rapid cooling, it was tested in the same manner as in Example 1. The storage stability of the comparative treating agent (II) was also checked.

COMPARATIVE EXAMPLE 3

Comparative treating agent (III) was prepared by mixing 1.2 parts by volume of primary magnesium phosphate aqueous solution (2 $MgO/P_2O_5$ mole ratio=1.0, non-volatile content=28.6% by volume), 18.3 parts by volume of siliceous sand powder and 42.6 parts by volume of water in a pot mill for 8 hours. According to the same procedure as in Example 2, the comparative treating agent (III) diluted with 18 parts by volume of water so as to have a non-volatile content of 20.7% by volume was coated by an air sprayer on a steel plate at a rate of 50 cc/m$^2$ in such a manner as to obtain a dry film thickness of 10$\mu$. The coated steel plate was then dried at 200° C. for one minute, and the surface of the coating film was checked. The steel plate was then dipped in a molten zinc bath at 460° C. for 5 seconds. After subjecting the steel plate to rapid cooling, it was tested in the same manner as in Example 1. The storage stability of the comparative treating agent (III) was also checked.

COMPARATIVE EXAMPLE 4

Comparative treating agent (IV) was prepared by mixing 12.6 parts by volume of primary magnesium phosphate aqueous solution (2 $MgO/P_2O_5$ mole ratio=1.0, non-volatile content=28.6% by volume) and 0.8 part by volume of clay in a mixer.

According to the same procedure as in Example 2, the comparative treating agent (IV) diluted with 12 parts by volume of water so as to have a non-volatile content of 17.3% by volume was coated by an air sprayer on a steel plate at a rate of 50 cc/m$^2$ in such a manner as to obtain a dry film thickness of 9$\mu$. The coated steel plate was then dried at 350° C. for one minute, and the surface of the coating film was checked. The steel plate was then dipped in a molten zinc bath at 460° C. for 5 seconds. After subjecting the steel plate to rapid cooling, a part of the steel plate was tested in the same manner as in Example 1, and the remaining part was checked by a leveller with regard to the removability of the comparative treating agent (IV). The storage stability of the comparative treating agent (IV) was also checked.

COMPARATIVE EXAMPLE 5

Comparative treating agent (V) comprising primary aluminum phosphate aqueous solution (3 $Al_2O_3/P_2O_5$ mole ratio=1.0, non-volatile content=14% by volume) alone was coated by an air sprayer on a steel plate at a rate of 50 cc/m$^2$ in such a manner as to obtain a dry film thickness of 7$\mu$ according to the same procedure as in Example 2. The coated steel plate was then dried at 350° C. for two minutes, and the surface of the coating film was checked. The steel plate was then dipped in a molten zinc bath at 460° C. for 5 seconds. After subjecting the steel plate to rapid cooling, a part of the steel plate was tested in the same manner as in Example 1, and the remaining part was checked with regard to the removability of the comparative treating agent (V) by Scotch Bright (adhesive). The storage stability of the comparative treating agent (V) was also checked.

COMPARATIVE EXAMPLE 6

Comparative treating agent (VI) having a non-volatile content of 9% by volume was prepared by mixing 7.1 parts by volume of titanium oxide and 70 parts by volume of water in a mixer.

According to the same procedure as in Example 2, the comparative treating agent (VI) was coated by an air sprayer on a steel plate at a rate of 110 cc/m$^2$ in such a manner as to obtain a dry film thickness of 10$\mu$. The coated steel plate was dried at 200° C. for one minute, and the surface of the coating film was checked. The steel plate was then dipped in a molten zinc bath at 460° C. for 5 seconds. After subjecting the steel plate to rapid cooling, it was tested in the same manner as in Example 1. The storage stability of the comparative treating agent (VI) was also checked.

Table 1

| | | Performance of Plating-Inhibitor | | | | | | |
|---|---|---|---|---|---|---|---|---|
| | | Surface state of plating-inhibitor film | Adherence of molten metal to plating-inhibitor layer | Occurrence of temper color on steel plate | Removability of plating-inhibitor | | | Storage stability of plating-inhibitor |
| | No. | (1) | (2) | (3) | Method A (4) | Method B (5) | Method C (6) | (7) |
| Example | 1 | O | Δ | ⊙ | Δ | | | O |
| | 2 | O | ⊙ | O | ⊙ | | | O |
| | 3 | O | O | ⊙ | O | | | O |
| | 4 | O | ⊙ | O | O | | | O |
| | 5 | O | O | ⊙ | O | O | | ⊙ |
| | 6 | ⊙ | O | O | O | | O | ⊙ |
| | 7 | O | O | O | O | | | O |
| | 8 | ⊙ | ⊙ | ⊙ | Δ | | | ⊙ |
| | 9 | Δ | O | O | O | | | Δ |
| | 10 | ⊙ | O | O | O | | | O |
| | 11 | O | Δ | O | O | | | O |
| | 12 | Δ | ⊙ | O | ⊙ | | | Δ |
| | 13 | O | ⊙ | O | O | | | ⊙ |
| | 14 | O | ⊙ | O | ⊙ | | | Δ |
| Comparative Example | I | x | x | x | x | | | O |
| | II | x | x | x | x | | | O |
| | III | Δ | O | x | O | | | x |
| | IV | Δ | x | O | x | | x | O |
| | V | x | x | O | x | x | | O |
| | VI | Δ | O | x | O | | | x |

(1) Surface state of plating-inhibitor film
- ⊙—There are no defects at all such as flowing, cracking, cissing, foaming, unevenness of film thickness and the like.
- O—There are substantially no defects.
- Δ—There are a little defects (but practically usable).
- X—There are many defects.

(2) Adherence of molten metal to plating-inhibitor layer
- ⊙—Molten metal does not adhere to plating-inhibitor layer at all.
- O—Molten metal does not adhere to plating-inhibitor layer substantially.
- Δ—Molten metal adheres to plating-inhibitor layer a little (but practically usable).
- X—Molten metal adheres to plating-inhibitor layer much.

(3) Occurrence of temper color on steel plate
- ⊙—Temper color does not occur at all.

O—Temper color does not occur substantially.
Δ—Temper color occurs a little (but practically usable).
X—Temper color occurs much.

Removability of plating-inhibitor layer (4) Method A: Reciprocation times of a brass wire brush until the naked surface of the steel plate is revealed.
⊙—50 times or less
O—50–200 times
Δ—200–500 times (but practically usable)
x—1000 times or more (5) Method B (by Scotch Bright) and (6) Method C (by leveller)
⊙—Plating-inhibitor does not remain on steel plate at all after removing operation.
O—Plating-inhibitor does not remain substantially.
Δ—Plating-inhibitor remains a little (but practically usable).
x—Plating-inhibitor remains much.

(7) Storage stability of plating-inhibitor
⊙—Solid contents in plating-inhibitor do not settle at all and the original dispersion state is maintained.
O—Solid contents do not settle substantially.
Δ—Solid contents settle a little, but the original dispersion state is restored by a mild stirring (practically usable).
x—Solid contents settle much and the original dispersion state is not restored by a mild stirring.

What we claim is:

1. A plating-inhibitor capable of use in partially plating a steel plate with a molten metal, comprising (a) at least one water-soluble phosphate type base selected from the group consisting of (i) metal phosphates, (ii) metal condensed phosphates and (iii) their modified metal phosphates, said water-soluble phosphate type base having a $xM_2O_x/P_2O_5$ mole ratio of 0.3–3.0, wherein M is a metal atom having a valence of 1 to 4 and x is the valence of the metal atom, and (b) at least one inorganic inert powdery material having a particle size of 1–100μ which is heat-resistant and substantially non-reactive with the molten metal, the non-volatile content volume ratio of said ingredient (a) to said ingredient (b) being 5–70:95–30.

2. A plating-inhibitor according to claim 1, wherein said phosphate type base is partly replaced by a water-soluble or water-dispersible alkali metal silicate and silica sol, the non-volatile content amount of the alkali metal silicate being 30% or less by volume on the basis of the total volume amount of the phosphate type base and the alkali metal silicate, and the non-volatile content amount of the silica sol being 80% or less by volume on the basis of the total volume amount of the phosphate type base and the silica sol.

3. A plating-inhibitor according to claim 1, wherein said phosphate type base is partly replaced by a water-soluble or water-dispersible alkali metal silicate and alumina sol, the non-volatile content amount of the alkali metal silicate being 30% or less by volume on the basis of the total volume amount of the phosphate type base and the alkali metal silicate, and the non-volatile content amount of the alumina sol being 80% or less by volume on the basis of the total volume amount of the phosphate type base and the alumina sol.

4. A plating-inhibitor according to claim 1, wherein said phosphate type base is partly replaced by water-soluble or water-dispersible quaternary ammonium silicate and silica sol, the non-volatile content amount of the quaternary ammonium silicate being 30% or less by volume on the basis of the total volume amount of the phosphate type base and the quaternary ammonium silicate, and the non-volatile content amount of silica sol being 80% or less by volume on the basis of the total volume amount of the phosphate type base and the silica sol.

5. A plating-inhibitor according to claim 1, wherein said phosphate type base is partly replaced by water-soluble or water-dispersible quaternary ammonium silicate and alumina sol, the non-volatile content amount of the quaternary ammonium silicate being 30% or less by volume on the basis of the total volume amount of the phosphate type base and the quaternary ammonium silicate, and the non-volatile content amount of the alumina sol being 80% or less by volume on the basis of the total volume amount of the phosphate type base and the alumina sol.

6. A plating-inhibitor according to claim 1, wherein said phosphate type base is partly replaced by a water-soluble or water-dispersible alkali metal silicate, silica sol and alumina sol, the non-volatile content amount of the alkali metal silicate being 30% or less by volume on the basis of the total volume amount of the phosphate type base and the alkali metal silicate, and the total non-volatile content amount of silica sol and alumina sol being 80% or less by volume on the basis of the total volume amount of the phosphate type base, the silica sol and the alumina sol.

7. A plating-inhibitor according to claim 1, wherein said phosphate type base is partly replaced by water-soluble or water-dispersible quaternary ammonium silicate, silica sol and alumina sol, the non-volatile content amount of the quaternary ammonium silicate being 30% or less by volume on the basis of the total volume amount of the phosphate type base and the quaternary ammonium silicate, and the total non-volatile content amount of silica sol and alumina sol being 80% or less by volume on the basis of the total volume amount of the phosphate type base, the silica sol and the alumina sol.

8. A plating-inhibitor according to claim 1, wherein a part of said water-soluble phosphate type base is replaced by at least one member selected from the group consisting of alkali metal silicates and quaternary ammonium silicate.

9. A plating-inhibitor according to claim 8, wherein said phosphate type base is partly replaced by a water-soluble or water-dispersible alkali metal silicate in a non-volatile content amount of 30% or less by volume on the basis of the total volume amount of the phosphate type base and the alkali metal silicate.

10. A plating-inhibitor according to claim 8, wherein said phosphate type base is partly replaced by water-soluble or water-dispersible quaternary ammonium silicate in a non-volatile content amount of 30% or less by volume on the basis of the total volume amount of the phosphate type base and the quaternary ammonium silicate.

11. A plating-inhibitor according to claim 1, wherein a part of said water-soluble phosphate type base is replaced by at least one member selected from the group consisting of silica sol having a $SiO_2$ particle size of 1–100 mμ and alumina sol having an $Al_2O_3$ particle size of 1–250 mμ.

12. A plating-inhibitor according to claim 11, wherein said phosphate type base is partly replaced by silica sol in a non-volatile content amount of 80% or less by volume on the basis of the total volume amount of the phosphate type base and the silica sol.

13. A plating-inhibitor according to claim 11, wherein said phosphate type base is partly replaced by alumina sol in a non-volatile content amount of 80% or less by volume on the basis of the total volume amount of the phosphate type base and the alumina sol.

14. A plating-inhibitor according to claim 11, wherein said phosphate type base is partly replaced by both silica sol and alumina sol, the total non-volatile content amount of silica sol and alumina sol being 80% or less by volume on the basis of the total volume amount of the phosphate type base, the silica sol and the alumina sol.

15. A plating-inhibitor according to claim 11, wherein said alkali metal silicate has an $SiO_2/M''_2O$ ($M''$=an alkali metal) mole ratio of 1.0–20.

16. A plating-inhibitor according to claim 11, wherein said silica sol has a pH of 8.0–10.0; an $SiO_2$ content of 20–40% by weight; and an $Na_2O$ content of 0.6% or less by weight.

17. A plating-inhibitor according to claim 11, wherein said silica sol has a pH of 3.0–4.0; an $SiO_2$ content of 20–21% by weight; and an $Na_2O$ content of 0.02% or less by weight.

18. A plating-inhibitor according to claim 11, wherein said alumina sol has a pH of 2.5–6.0; and an $Al_2O_3$ content of 10% or more by weight.

* * * * *